US010954957B2

(12) United States Patent
Rowland

(10) Patent No.: US 10,954,957 B2
(45) Date of Patent: Mar. 23, 2021

(54) FAN ASSEMBLY

(71) Applicant: TRUFLO AIR MOVEMENT LTD, West Midlands (GB)

(72) Inventor: Ian Rowland, West Midlands (GB)

(73) Assignee: TRUFLO AIR MOVEMENT LTD, West Midlands (GB)

( * ) Notice: Subject to any disclaimer, the term of this patent is extended or adjusted under 35 U.S.C. 154(b) by 266 days.

(21) Appl. No.: 16/313,384

(22) PCT Filed: Jun. 26, 2017

(86) PCT No.: PCT/GB2017/051853
§ 371 (c)(1),
(2) Date: Dec. 26, 2018

(87) PCT Pub. No.: WO2018/002592
PCT Pub. Date: Jan. 4, 2018

(65) Prior Publication Data

US 2019/0195237 A1 Jun. 27, 2019

(30) Foreign Application Priority Data

Jun. 27, 2016 (GB) ..... 1611144

(51) Int. Cl.
*F04D 29/36* (2006.01)
*F04D 29/34* (2006.01)
(Continued)

(52) U.S. Cl.
CPC ..... *F04D 29/34* (2013.01); *F04D 29/36* (2013.01); *F04D 29/646* (2013.01);
(Continued)

(58) Field of Classification Search
CPC ..... F04D 29/34; F04D 29/36; F04D 29/646; F04D 19/002; F04D 29/322; F04D 29/323; F05D 2230/64; F05D 2300/603
(Continued)

(56) References Cited

U.S. PATENT DOCUMENTS 2,620,039 A * 12/1952 Allen ..... F04D 29/36 416/207
3,161,239 A * 12/1964 Andersen ..... F04D 29/34 416/214 R
(Continued)

FOREIGN PATENT DOCUMENTS

GB 2362927 A * 12/2001 ..... F04D 29/384
WO WO-2010061195 A1 * 6/2010 ..... F04D 29/34
(Continued)

*Primary Examiner* — Christopher Verdier
*Assistant Examiner* — Theodore C Ribadeneyra
(74) *Attorney, Agent, or Firm* — FisherBroyles, LLP

(57) ABSTRACT

Improvements in and relating to a fan assembly A fan assembly comprising a fan assembly hub having opposing portions, each opposing portion being provided with at least one locating region, and at least one fan blade, the or each fan blade having an attachment portion having at least one projection to each side, the or each fan blade being secured between the opposing portions of the fan assembly hub, in which the fan assembly further comprises a plurality of tapered angle adjusters, each tapered angle adjuster comprising first and second major surfaces, the first major surface being disposed at an angle to the second major surface, the first major surface being provided with a projection and the second major surface being provided with a recess, at least one of the tapered angle adjusters being located to each side of the attachment portion of the fan blade between the attachment portion of the fan blade and the adjacent fan assembly hub portion.

10 Claims, 6 Drawing Sheets

(51) Int. Cl.
*F04D 29/64* (2006.01)
*F04D 19/00* (2006.01)

(52) U.S. Cl.
CPC ..... *F04D 19/002* (2013.01); *F05D 2230/64* (2013.01); *F05D 2300/603* (2013.01)

(58) Field of Classification Search
USPC ..... 416/205, 207, 208, 214 R
See application file for complete search history.

(56) References Cited

U.S. PATENT DOCUMENTS 4,251,309 A * 2/1981 Class ..... B29C 70/342 156/173
4,969,799 A * 11/1990 Usui ..... F04D 29/368 416/39
6,139,277 A * 10/2000 Lopatinsky ..... F01D 5/3015 416/220 A
7,331,764 B1 * 2/2008 Reynolds ..... F04D 29/023 416/204 R
7,456,541 B2 * 11/2008 Horng ..... F04D 25/0653 310/156.32
8,128,372 B2 * 3/2012 Best ..... F04D 29/34 416/219 R
8,177,512 B2 * 5/2012 Mosiewicz ..... F04D 29/34 416/204 R
10,415,587 B2 * 9/2019 Cahill ..... F04D 29/388
10,443,608 B2 * 10/2019 Kobayashi ..... F04D 29/34
10,662,972 B2 * 5/2020 Baer ..... F04D 29/325
2003/0219340 A1 * 11/2003 Hidalgo ..... F04D 29/34 416/206
2003/0231960 A1 * 12/2003 Asada ..... F04D 29/34 416/210 R
2004/0042903 A1 * 3/2004 Huang ..... F04D 29/36 416/207
2009/0035144 A1 * 2/2009 Wang ..... F04D 29/34 416/220 R
2009/0324413 A1 * 12/2009 Streng ..... F04D 29/388 416/219 R
2011/0158813 A1 * 6/2011 Bucher ..... F04D 25/088 416/210 R
2012/0321467 A1 * 12/2012 He ..... F04D 29/388 416/144
2013/0189109 A1 * 7/2013 Noble ..... F04D 29/384 416/219 R
2017/0037870 A1 * 2/2017 Cahill ..... F04D 29/388

FOREIGN PATENT DOCUMENTS

WO WO-2014117288 A1 * 8/2014 ..... F04D 17/025
WO WO-2018002592 A1 * 1/2018 ..... F04D 29/36

* cited by examiner

FAN ASSEMBLY

PRIORITY APPLICATIONS

This application is a U. S. National Stage Filing under 35 U.S.C. 371 from International Application No. PCT/GB2017/051853, filed on 26 Jun. 2017 and published as WO 2018/002592 on 4 Jan. 2018, which claims the benefit of priority to United Kingdom Patent Application No. 1611144.5 filed 27 Jun. 2016, which applications and publication are incorporated herein by referenced in their entirety.

This invention relates to improvements in and relating to a fan assembly and in particular to an improved means of construction of a fan assembly.

Known fan assemblies may have fan blades constructed of metal or plastics material. Typically, the blades comprise a portion which is exposed to air in normal use and a portion which serves in connecting the blade to the fan assembly hub (the attachment portion). The portion exposed to air in normal use may be twisted relative to the attachment portion.

It is known to provide a fan blade assembly having a fan assembly hub having opposing portions and a number of fan blades secured in a fixed position between the opposing portions of the fan assembly hub. The opposing portions of the fan assembly hub are provided with a number of locating regions. Each fan blade is provided with an attachment portion comprising projections each of which engage with a corresponding locating region in the fan assembly hub.

It will be understood that different fan assemblies will require a range of fan blades each having an exposed portion twisted at different angles to the attachment portion and that in order to manufacture a range of fan assemblies a range of such fan blades must be kept in stock in order to do so.

The need to keep a suitably broad inventory of such a variety of fan blades creates a logistical issue for the manufacturers of such fan assemblies.

It is an advantage of the present invention that it addresses this problem.

According to a first aspect of the present invention a fan assembly comprises a fan assembly hub having opposing portions, each opposing portion being provided with at least one locating region, and at least one fan blade, the or each fan blade having an attachment portion having at least one projection to each side, the or each fan blade being secured between the opposing portions of the fan assembly hub, in which the fan assembly further comprises a plurality of tapered angle adjusters, each tapered angle adjuster comprising first and second major surfaces, the first major surface being disposed at an angle to the second major surface, the first major surface being provided with a projection and the second major surface being provided with a recess, at least one of the tapered angle adjusters being located to each side of the attachment portion of the fan blade between the attachment portion of the fan blade and the adjacent fan assembly hub portion.

Preferably, the or each locating region in each opposing portion of the fan assembly hub comprises a recess or an opening.

Preferably each portion of the fan assembly hub is made of steel.

Preferably each fan blade is made of injection-moulded short stranded thermoplastic glass fibre.

Preferably one of the portions of the fan assembly hub is in the form of a ring.

Preferably, each tapered angle adjuster has first and second ends and first and second opposing side surfaces, the first and second ends and the opposing side surfaces bounding the first and second major surfaces. More preferably, the tapered angle adjuster is symmetrical about a centre line mid-way between the first and second ends.

Preferably, the first and second major surfaces may be inclined at an angle of up to 5 degrees to one another.

Preferably, the opposing portions of the fan assembly hub are each provided with a plurality of through bores adapted to be aligned in use, and the fan assembly is further provided with fastening means extending through the plurality of through bores to anchor the attachment portion of each blade and the associated tapered angle adjusters between the opposing portions of the fan assembly hub.

More preferably, each of the tapered angle adjuster and each attachment portion of each blade is also provided with a plurality of through bores adapted to be aligned in use with the through bores of the opposing portions of the fan assembly hub when anchoring each blade and the associated tapered angle adjusters between the opposing portions of the fan assembly hub.

The invention will now be described, by way of example only, in relation to the attached Figures, in which FIG. 1 shows a fan blade for use in accordance with the present invention;

In discussing the Figures like parts will be referred to by like reference numerals.

Figure 1:
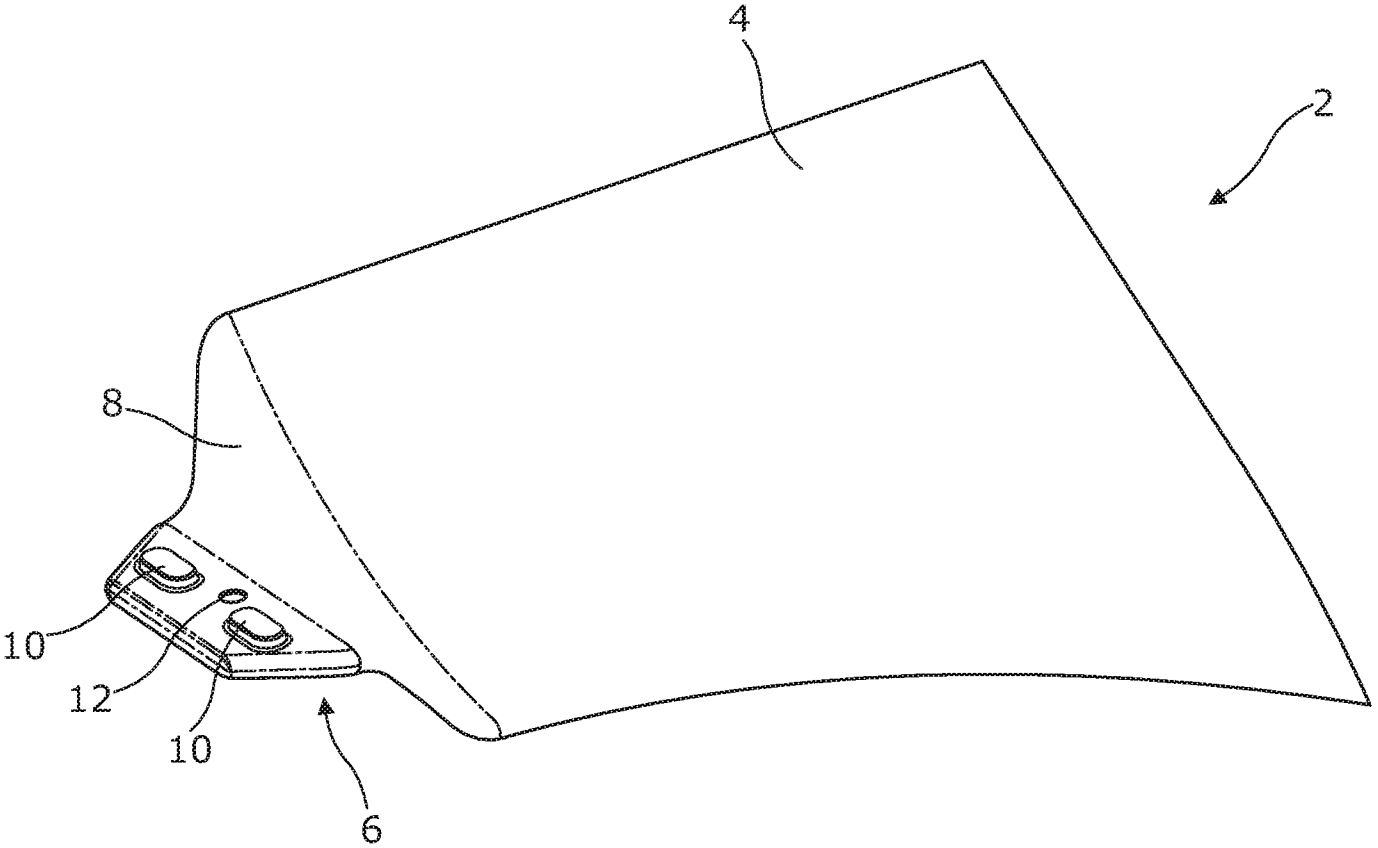

Referring first to FIG. 1, there can be seen a fan blade 2 for use in the present invention. The fan blade 2 comprises a first portion 4, which will be exposed to air in normal use, and an attachment portion 6, which serves in connecting the fan blade to a fan assembly hub. Between the attachment portion 6 and the first exposed portion 4 is a pitch-twisted portion 8 which serves to impart a particular angle to the first portion of the blade with respect to the attachment portion 6, for example a 26 degree angle. Such an angle may be chosen to conform to any angle conventionally used in the art.

Portions 4, 6 and 8 of the fan blade 2 are all integral parts of the fan blade being injection-moulded in a known manner. In the illustrated embodiment the fan blade 2 is made from short-stranded thermoplastic glass fibre.

Figure 6:
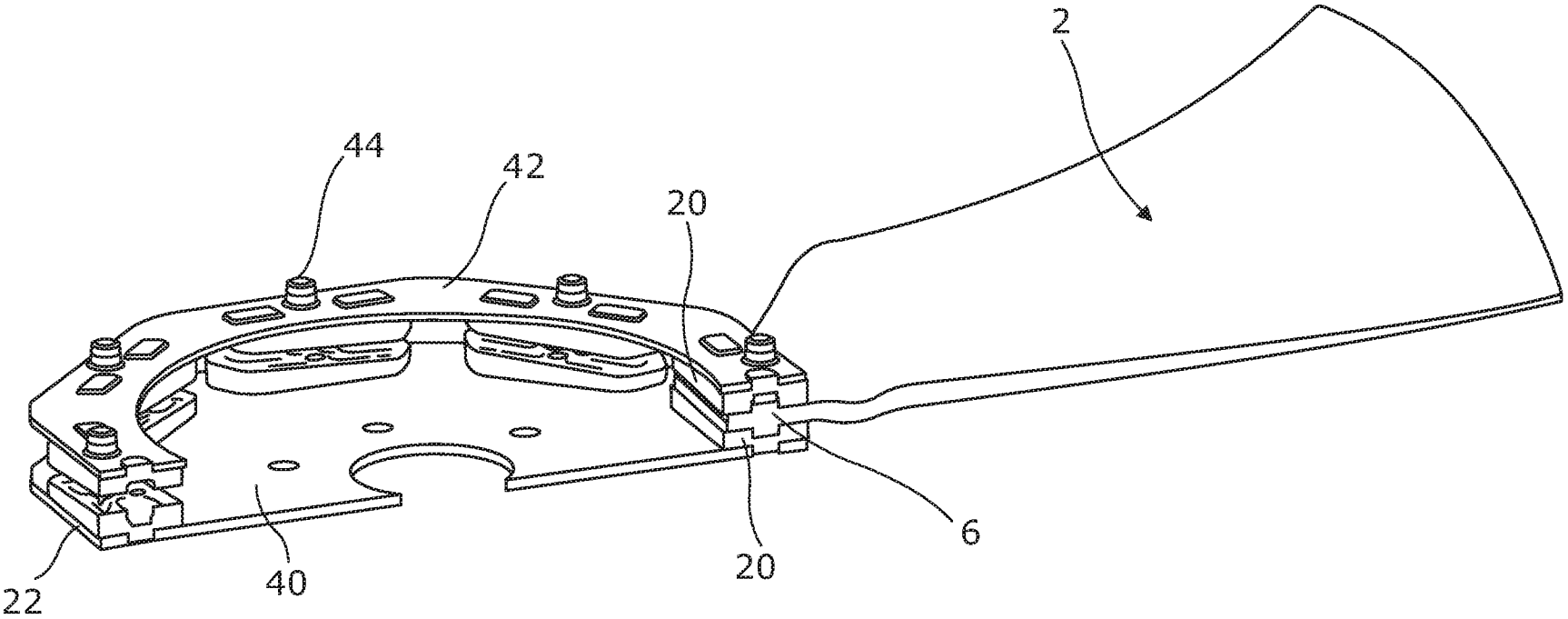
FIG. 6 shows a sectional view of the fan blade assembly of FIG. 5.

The attachment portion 6 of the fan blade 2 can be seen to comprise integrally-moulded projections or lugs 10 on both surfaces of the attachment portion (see also FIG. 6). The lugs 10 conveniently extend orthogonally from the surrounding surface. The attachment portion 6 may also have one or more fastening holes 12 for accepting conventional fastenings (e.g. rivets).

Figure 2:
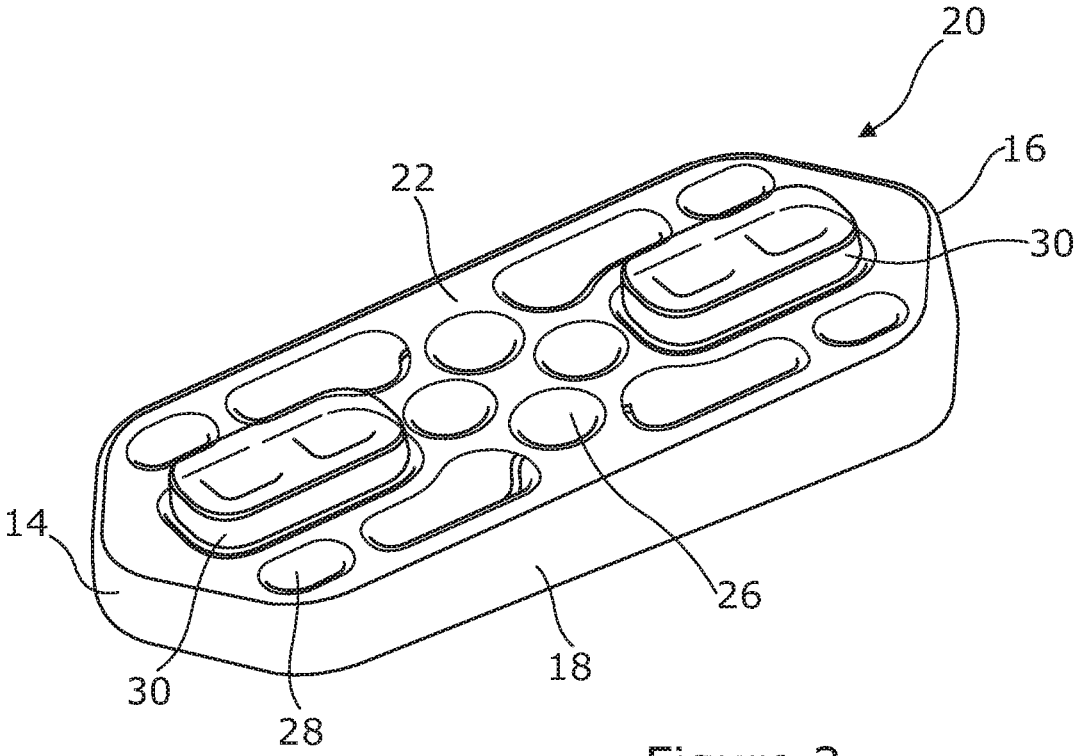
FIG. 2 shows an upper perspective view of a tapered angle adjuster for use in the present invention.
Figure 3:
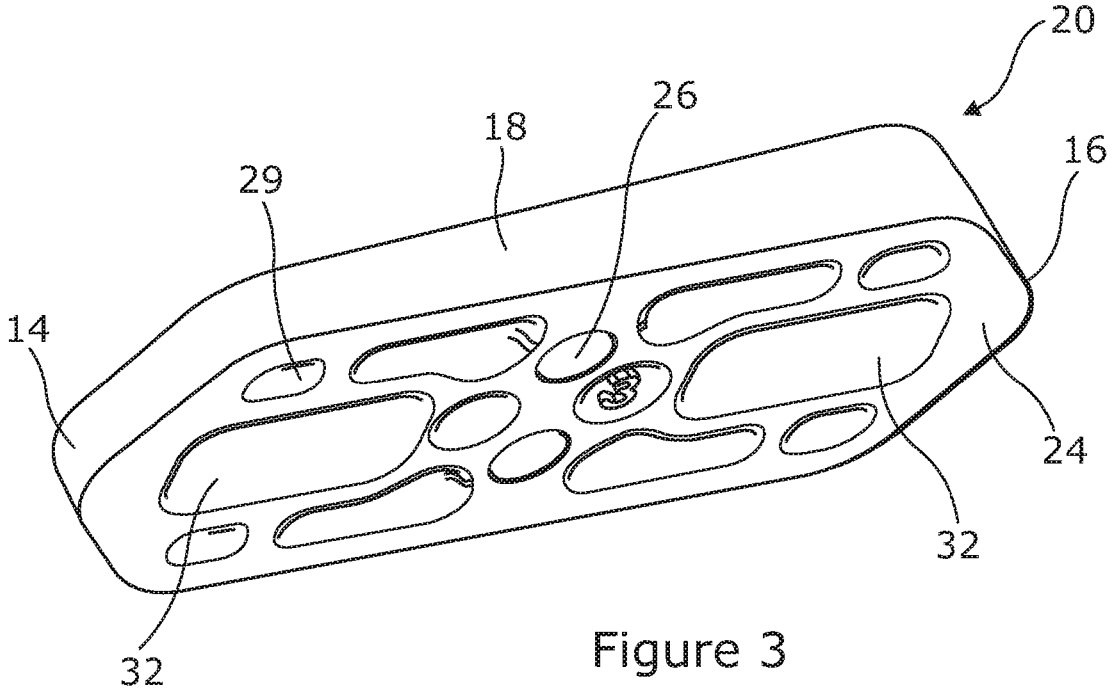
FIG. 3 shows a lower perspective view of a tapered angle adjuster for use in the present invention.

FIGS. 2 and 3 show an example tapered angle adjuster 20. The tapered angle adjuster 20 is generally rectangular having first and second ends 14,16, and opposing side surfaces 18. The first and second ends 14,16 and the opposing side surfaces 18 bound first and second major surfaces 22,24. The first major surface 22 is disposed at an angle to the second major surface 24 such that the first end 14 of the tapered angle adjuster 20 is thinner than the second end 16 of the tapered angle adjuster 20. For example, the first and second major surfaces 22,24 may be inclined at an angle of 3 degrees to one another. Conveniently the tapered angle adjuster is symmetrical about a centre line mid-way between the first and second ends 14,16. In the fan assembly to be described, each of the tapered angle adjusters 20 are of equal thickness at this centre line.

The first major surface 22 is provided with at least one projection 30. The projection 30 extends orthogonally from the first major surface. Two such projections 30 are shown in the illustrated embodiment. One or more through holes 26 may conveniently be provided for accepting conventional fastenings. Additional recesses 28 may be provided on the first major surface 22 thereby producing a lighter angle adjuster. It will be appreciated that a lighter fan blade assembly is generally desirable. In addition, such recesses allow for an even moulding and wall thickness.

The second major surface 24 is provided with at least one recess 32. The recess 32 is provided with a side wall extending orthogonally from the second major surface 24. Two such recesses 32 are shown in the illustrated embodiment. Additional recesses 29, similar to the recesses 28, are provided on the second major surface 24.

The depth of the recesses 28, 29 on the major surfaces 22,24 of each tapered angle adjuster may vary.

Figure 4:
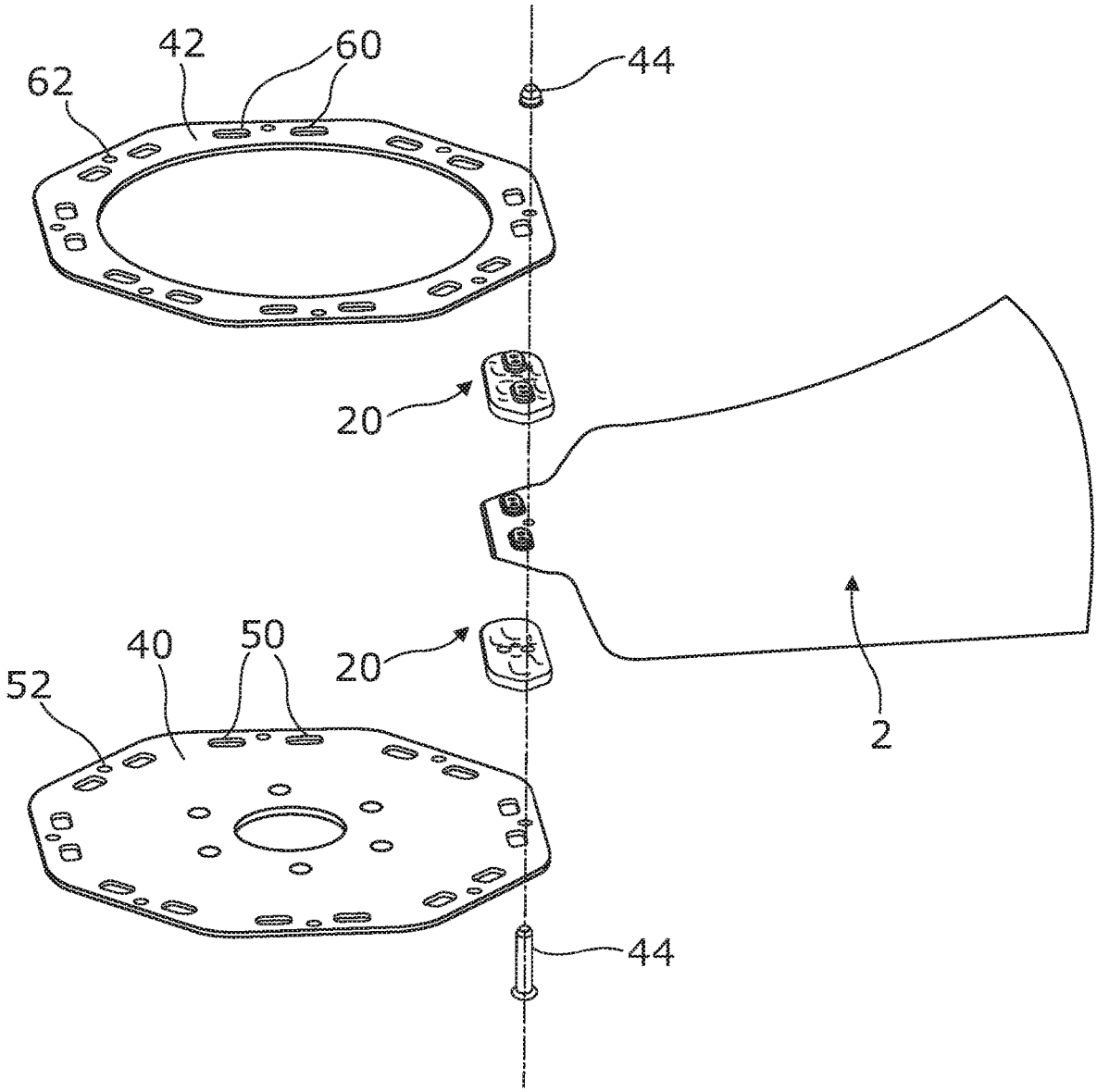
FIG. 4 shows an exploded view showing elements of a fan blade assembly in accordance with the present invention.

Referring now to FIG. 4, it can be seen that a fan assembly in accordance with the invention comprises at least one fan blade 2, first and second fan assembly portions 40,42 and fastenings 44. For simplicity, only one fan blade 2 is shown.

To construct the fan assembly, a first fan assembly portion in the form of a hub plate 40 is provided. The first fan assembly portion 40 has an upper surface and includes about its periphery a plurality of location regions comprising holes or recesses 50. Side walls of the holes or recesses 50 are formed orthogonally to the upper surface. These may be formed as holes punched or cut through the first fan assembly portion or they may be moulded recesses. Conveniently, through holes 52 are provided about the periphery of the hub plate 40 for accepting conventional fastenings.

Each projection 30 (or each of the projections) on the first major face of a first tapered angle adjuster are located in a corresponding hole or recess 50 of the first fan assembly portion, each hole or recess 50 being of a complementary shape to the corresponding projection.

The projection (or projections) 10 formed on a first side of an attachment portion 6 of a fan blade are now located in the recess 32 (or recesses) formed on the exposed second major surface of the first tapered angle adjuster. Each projection 10 is of a complementary shape to the corresponding recess 32 of the first tapered angle adjuster.

A second tapered angle adjuster is then located on the exposed projection (or projections) on the second side of the attachment portion 6 of the fan blade, that is each recess 32 (or each of the recesses) on a second major face of the second tapered angle adjuster are located over the projection 10 (or projections) of the second side of the attachment portion 6 of the fan blade.

Figure 5:
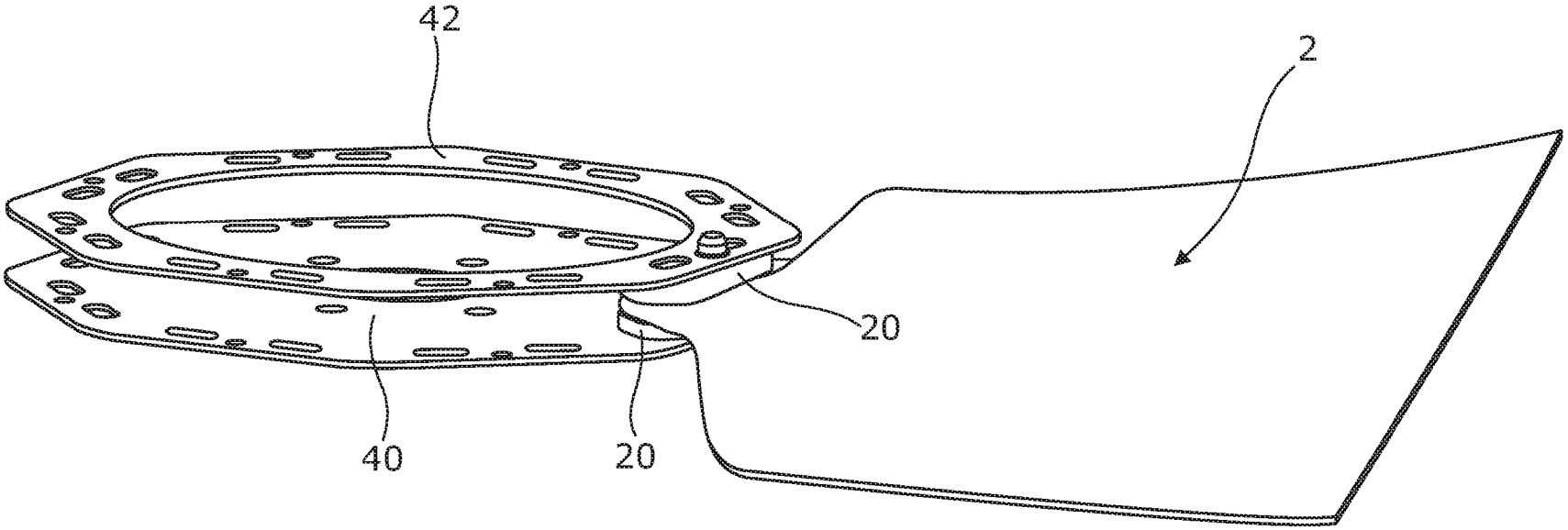
FIG. 5 shows a perspective view of a fan blade assembly in accordance with the present invention.

It is understood that this process is to be repeated for each additional fan blade (not shown in FIGS. 4, 5 and 6) intended to form part of the fan assembly.

A second fan assembly portion in the form of a clamping plate 42 is now provided. The second fan assembly portion 42 has a lower surface and includes about its periphery a plurality of location regions comprising holes or recesses 60. Side walls of the holes or recesses are formed orthogonally to the lower surface. These may be formed as holes punched or cut through the second fan assembly portion 42 as in the illustrated embodiment or they may be moulded recesses. Conveniently, through holes 62 are provided about the periphery of the clamping plate or second fan assembly portion 42 for accepting conventional fastenings.

Each hole or recess 60 of the second fan assembly portion 42 is located about the projection 30 (or each of the projections) on the first major face of each second tapered angle adjuster, each hole or recess 60 being of a complementary shape to the corresponding projection 30.

In this way the attachment portions 6 of each fan blade are sandwiched between first and second tapered angle adjusters 20 in turn sandwiched between the clamping plate 42 and the fan assembly hub 40.

Fastenings 44 pass through the holes 62 in the clamping plate 42 and the holes 52 in the fan assembly hub 40 to anchor the clamping plate 42 to the fan assembly hub 40. Other fastening means (e.g. welding) may be used instead or in addition.

In the illustrated embodiment, the fastenings 44 are shown as also passing through holes 12 in the attachment portion 6 of the fan blade and the holes 26 in the associated first and second tapered angle adjusters 20. Alternatively, the fastenings 44 may be located either side of the attachment portion 6 in order to anchor the attachment portion 6 in place.

If the first and second major surfaces 22,24 of the first and second tapered angle adjusters are inclined at an angle of 3 degrees to one another and used to secure a fan blade 2 in which the pitch-twisted portion 8 imparts a 26 degree angle to the exposed blade portion 4 with respect to the attachment portion 6, it can be seen that the exposed blade portion 4 may now be disposed at a 29 degree angle to a plane defined by the first and 25 second fan assembly portions 40,42. However, because each tapered angle adjuster 20 is symmetrical about its centre line, the same tapered angle adjusters 20 may be rotated 180 degrees about the centre line to provide an adjustment of −3 degrees that the exposed blade portion 4 may now be disposed at a 23 degree angle to a plane defined by the first and second fan assembly portions 40,42.

By providing sets of tapered angle adjusters in which the first and second major surfaces each vary by say 1 degree, over a range of say 1 to 5 degrees, a single set of a fan blades in which a pitch-twisted portion imparts a 26 degree angle to the exposed blade portion degree and just five sets of tapered angle adjusters may be used to create a range of fan assemblies in which the pitch-twisted portion of each blade is disposed at 21, 22, 23, 24, 25, 27, 28, 29, 30 or 31 degrees to the plane defined by the first and second fan assembly portions.

Further if the sets of tapered angle adjusters all have the same thickness at the centre line about which they are symmetric, the separation of the first and second fan assembly portions will remain the same as between the range of fan assemblies described in the preceding paragraph. In other words, a range of fan assemblies having the same fan hub assembly dimensions can be manufactured from a limited set of parts while allowing for flexibility in the angle of the fan blades with respect to the plane defined by the first and second fan assembly portions.

Accordingly, by use of the present invention it is not necessary to manufacture a range of fan blades having differencing pitch twisted portions, rather only a single set of blades need be manufactured with a plurality of sets of tapered angle adjusters each set having a different angle between the first and second major surfaces of the tapered angle adjusters. In this way the storage space and logistical problems of storing a range of fan blades for manufacture into a fan blade assembly is reduced.

Figure 7:
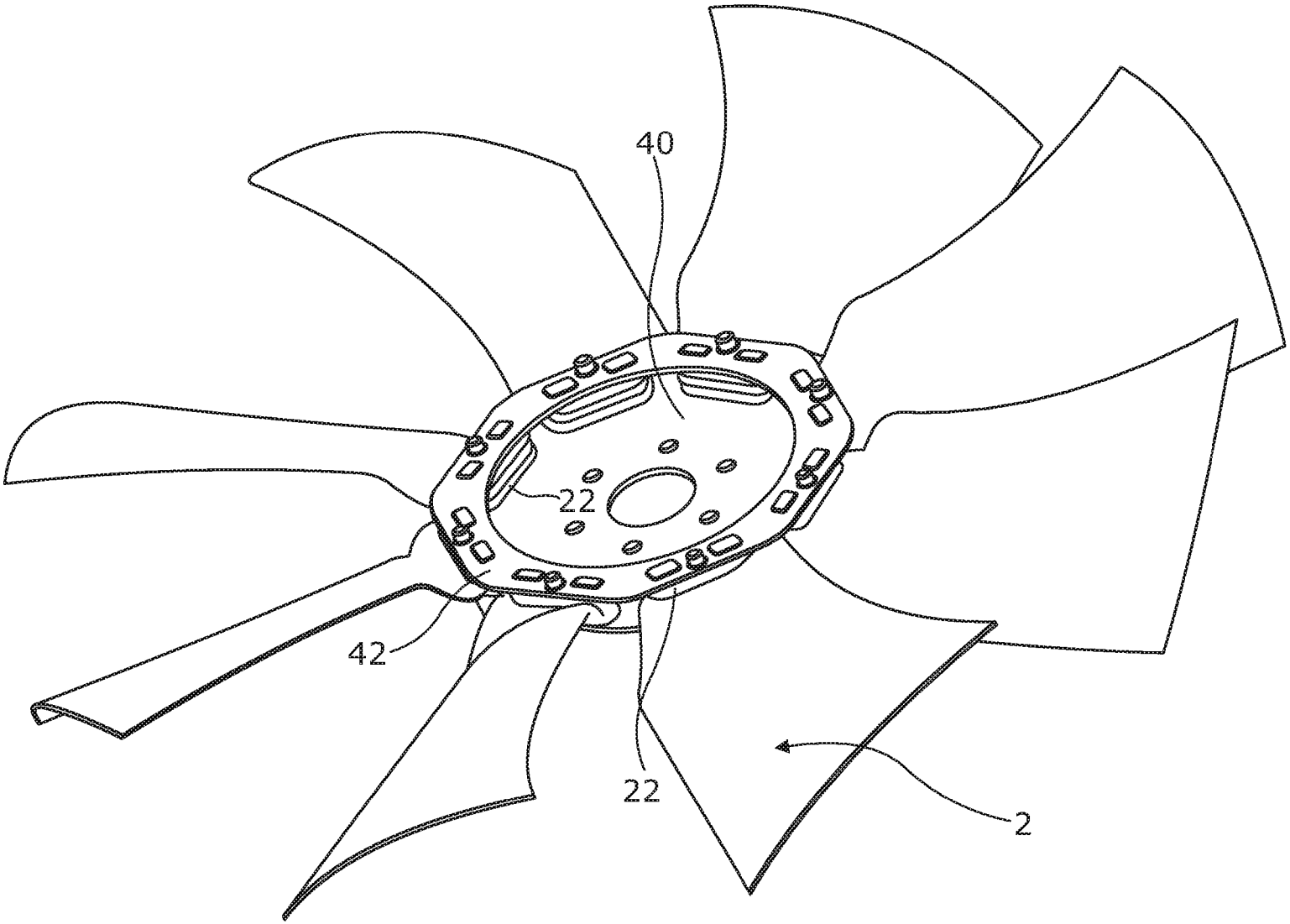
FIG. 7 shows a perspective view of a completed fan blade assembly in accordance with the present invention.

A completed fan assembly with all the fan blades in place is shown in FIG. 7.

The invention claimed is:

1. A fan assembly comprising a fan assembly hub having opposing portions, each opposing portion being provided with at least one locating region, and at least one fan blade, the or each fan blade having an attachment portion having at least one projection to each side, the or each fan blade being secured between the opposing portions of the fan assembly hub, in which the fan assembly further comprises a plurality of tapered angle adjusters, each tapered angle adjuster comprising first and second major surfaces, the first major surface being disposed at an angle to the second major surface, the first major surface being provided with a projection and the second major surface being provided with a recess, at least one of the tapered angle adjusters being located to each side of the attachment portion of the fan blade between the attachment portion of the fan blade and the adjacent fan assembly hub portion.

2. The fan assembly according to claim 1, in which the or each locating region in each opposing portion of the fan assembly hub comprises a recess or an opening.

3. The fan assembly according to claim 1, in which each portion of the fan assembly hub is made of steel.

4. The fan assembly according to claim 1, in which each fan blade is made of injection-moulded short stranded thermoplastic glass fibre.

5. The fan assembly accordingly to claim 1, in which one of the portions of the fan assembly hub is in the form of a ring.

6. The fan assembly according to claim 1, in which each tapered angle adjuster has first and second ends and first and second opposing side surfaces, the first and second ends and the opposing side surfaces bounding the first and second major surfaces.

7. The fan assembly according to claim 6, in which the tapered angle adjuster is symmetrical about a centre line mid-way between the first and second ends.

8. The fan assembly according to claim 1, in which the first and second major surfaces are inclined at an angle of up to 5 degrees to one another.

9. The fan assembly according to claim 1, in which the opposing portions of the fan assembly hub are each provided with a plurality of through bores adapted to be aligned in use, and the fan assembly is further provided with fastening means extending through the plurality of through bores to anchor the attachment portion of each blade and the associated tapered angle adjusters between the opposing portions of the fan assembly hub.

10. The fan assembly according to claim 9, in which each of the tapered angle adjuster and each attachment portion of each blade is also provided with a plurality of through bores adapted to be aligned in use with the through bores of the opposing portions of the fan assembly hub when anchoring each blade and the associated tapered angle adjusters between the opposing portions of the fan assembly hub.

* * * * *